US005156134A

United States Patent [19]

Tochizawa

[11] Patent Number: 5,156,134

[45] Date of Patent: Oct. 20, 1992

[54] FUEL COOLING DEVICE FOR MOTOR VEHICLES

[75] Inventor: Tohru Tochizawa, Tochigi, Japan

[73] Assignee: Honda Giken Kogyo Kabushiki Kaisha, Tokyo, Japan

[21] Appl. No.: 851,550

[22] Filed: Mar. 13, 1992

[30] Foreign Application Priority Data

Mar. 22, 1991 [JP] Japan ..... 24596

[51] Int. Cl.[5] ..... F02M 31/00

[52] U.S. Cl. ..... 123/541; 123/468; 123/469

[58] Field of Search ..... 123/540, 541, 468, 469, 123/470

[56] References Cited

U.S. PATENT DOCUMENTS

| | | | |
|---|---|---|---|
| 3,973,536 | 8/1976 | Zelders | 123/541 |
| 4,155,337 | 5/1979 | Hensley | 123/541 |
| 4,519,354 | 5/1985 | Katoh et al. | 123/468 |
| 4,601,275 | 7/1986 | Weinand | 123/468 |
| 4,790,145 | 12/1988 | Thompson | 123/541 |
| 4,898,141 | 2/1990 | Fiedler | 123/541 |
| 4,938,036 | 7/1990 | Hodgkins | 123/541 |
| 5,092,300 | 3/1992 | Imoehl et al. | 123/469 |

*Primary Examiner*—E. Rollins Cross
*Assistant Examiner*—M. Macy
*Attorney, Agent, or Firm*—Armstrong & Kubovcik

[57] ABSTRACT

A fuel cooling device for motor vehicles which is adapted to cool fuel with refrigerant from an air-conditioning equipment. In a fuel delivery pipe for delivering the fuel into fuel injection valves, refrigerant passages connected to the refrigerant system of the air-conditioning equipment are juxtaposed, adjacently to the fuel passage. The fuel passage is formed longitudinally within the fuel delivery pipe. On both sides of this fuel passage are provided separate refrigerant passages extending in parallel with the fuel passage. These refrigerant passages communicate with each other in one end, and communicate with a refrigerant inlet pipe and a refrigerant outlet pipe in the other end. From the fuel passage are branched off a plurality of branch passages, which have their openings on a side surface of the fuel delivery pipe. The fuel injection valve is installed in each of the openings.

4 Claims, 2 Drawing Sheets

FUEL COOLING DEVICE FOR MOTOR VEHICLES

BACKGROUND OF THE INVENTION

1. Field of the Invention

The present invention relates to a fuel cooling device for motor vehicles equipped with a fuel-injection engine in which fuel is cooled with refrigerant from an air-conditioning equipment.

2. Description of the Prior Art

Such fuel cooling devises are known in the prior art as disclosed in for example Japanese Laid-Open Patent Publication No. Sho 59-62260.

In this fuel cooling device, a heat absorbing section of a heat pipe is inserted in a delivery pipe for delivering the fuel to fuel injection valves. The heat pipe is extended long from the delivery pipe, with a heat radiating section at the other end thereof being fixed to a low-pressure piping located between an evaporator and a compressor in a cooler system. The low-pressure piping, together with the heat-radiating section, is wrapped with a heat-insulating material. Heat of the fuel in the delivery pipe, therefore, is transferred to a low-temperature refrigerant in the low-pressure piping through the heat pipe, thereby cooling the fuel.

This fuel cooling device, using the heat pipe, is costly and complicated in construction. Furthermore, since the heat of fuel is transferred from the fuel to the refrigerant through the heat pipe, the cooling effect will lower that much.

SUMMARY OF THE INVENTION

In view of the above-described disadvantages inherent in the heretofore known techniques, according to the present invention, a fuel cooling device for motor vehicles equipped with a fuel-injection engine in which the fuel is cooled with refrigerant from an air-conditioning equipment, wherein a refrigerant passage for passing the refrigerant is provided within a fuel delivery pipe for delivering the fuel into fuel injection valves, juxtaposed with a fuel passage for passing the fuel and separated fluid-tight from the fuel passage is provided.

According to the present invention, the fuel delivery pipe has both a fuel delivery function and a fuel cooling function, and therefor it is unnecessary to install a fuel cooling device separately from the fuel delivery pipe, thus lowering the cost and simplifying the pipe construction. Furthermore, heat exchange between the fuel and the refrigerant is done directly through a passage wall within the fuel delivery pipe, thereby improving the cooling effect.

The above and other objects, features and advantages of the present invention will be more clear from the following description with reference to the accompanying drawings.

DESCRIPTION OF THE PREFERRED EMBODIMENT

Figure 1:
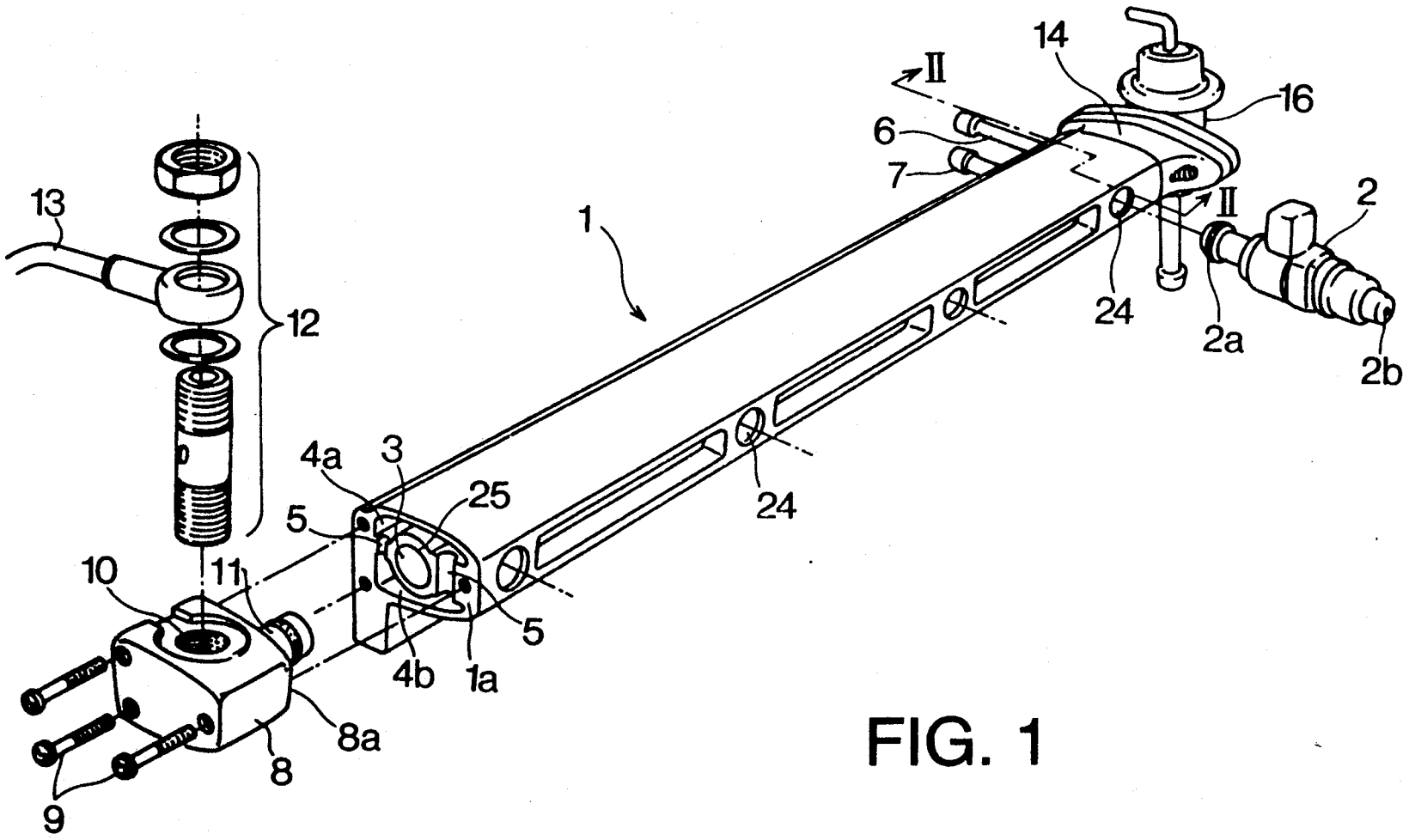
FIG. 1 is an exploded perspective view of one embodiment of a fuel delivery pipe according to the present invention which serves also as a fuel cooling device.
Figure 2:
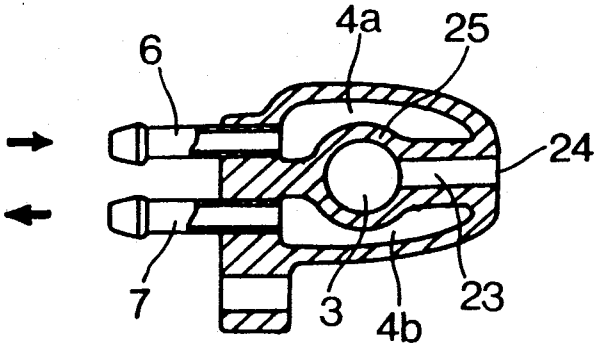
FIG. 2 is a sectional view taken along line II—II of FIG. 1.
Figure 3:
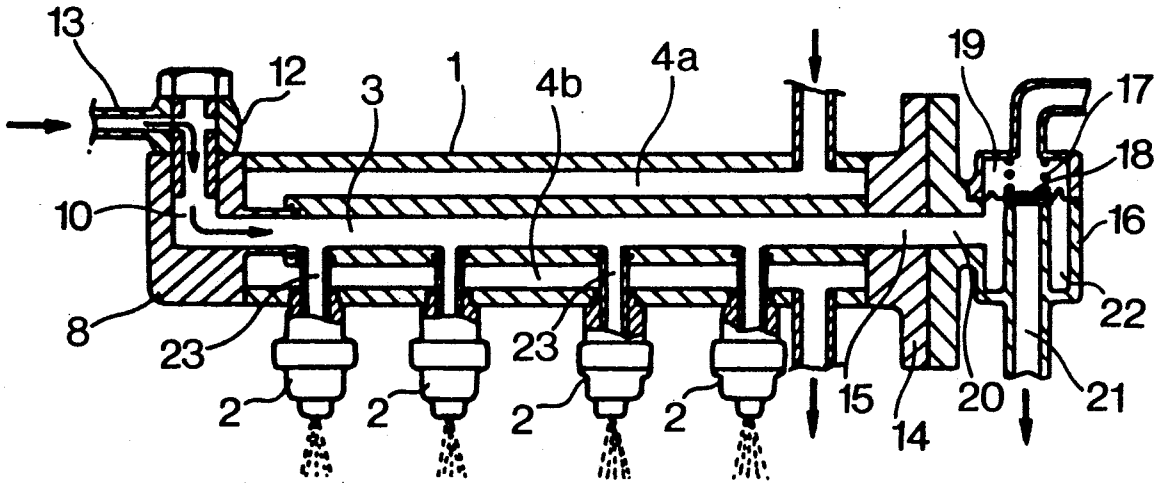
FIG. 3 is a longitudinal sectional view showing the concept of the fuel delivery pipe of FIG. 1.

Hereinafter an exemplary embodiment of a fuel cooling device according to the present invention will be described with reference to FIGS. 1 to 3.

In the drawings, a numeral 1 refers to a fuel delivery pipe, which is installed adjacently to intake pipes of an engine not illustrated. This fuel delivery pipe 1 is provided with four fuel injection valves 2 inserted each in a corresponding intake pipe.

The fuel delivery pipe 1 is a multilayer pipe produced of an aluminum extruded pipe with a fuel passage 3 formed in the central section longitudinally through the pipe. And refrigerant passages 4*a* and 4*b* are provided adjacently to the upper and lower sides thereof, surrounding the fuel passage 3. The refrigerant passages 4*a* and 4*b* are also provided longitudinally through the fuel delivery pipe 1. The upper and lower refrigerant passages 4*a* and 4*b* are connected to each other via connecting passages 5, 5 formed in the lefthand end (in the left end in this drawing; the same applies hereinafter) of the fuel delivery pipe 1, and also communicate with a refrigerant inlet pipe 6 and a refrigerant outlet pipe 7 respectively in the right-hand end. The refrigerant inlet pipe 6 and the refrigerant outlet pipe 7 project sidewardly of the fuel delivery pipe 1, vertically juxtaposed as shown in FIG. 1, being connected to the refrigerant system of the vehicle air-conditioning equipment.

On the left-hand end surface of the fuel delivery pipe 1 is attached a connecting block 8 by screws 9. An airtightness is maintained between the end face 1*a* of the fuel delivery pipe 1 and the end face 8*a* of the connecting block 8 by means of a seal member or the like, thereby maintaining air- and liquid-tightness between the fuel passages 3 and the refrigerant passages 4*a* and 4*b* including the connecting passages 5. In the connecting block 8 is formed an oil passage 10 curved in a shape of hook having an inlet on the upper surface side and an outlet on the mating surface 8*a* side. A projecting pipe 11 which is an outlet of the oil passage 10 is fitted liquid-tight in the fuel passage 3 of fuel delivery pipe 1. The inlet side of the oil passage 10 is connected to a fuel pipe 13 through a connector 12. The fuel pipe 13 is connected to a fuel tank through a fuel pump. The fuel pressurized by the fuel pump is sent from the fuel pipe 13 into the fuel passage 3 through the inlet passage 10 as indicated by an arrow in FIG. 3.

On the other end face of the fuel delivery pipe 1 is fixedly installed airtight a flange-like connecting block 14 in the same manner as the connecting block 8, thus closing the open end of the refrigerant passages 4*a* and 4*b*. The connecting block is provided with an outlet passage 15 communicating with the fuel passage 3. Attached to the connecting block 14 is a pressure regulator 16. The interior of this pressure regulator 16 is separated, by a diaphragm valve 18 loaded with a spring 17, into an upper chamber 19 communicating with the atmosphere and a lower chamber 22 communicating with the inlet passage 20 and an outlet passage 21, so that the outlet passage 21 will be opened and closed by the diaphragm valve 18. When the fuel pressure in the lower chamber 22 and the fuel passage 3 increases over a predetermined value, the diaphragm valve 18 opens, allowing the fuel in the fuel passage 3 to escape into the outlet passage 21. When the fuel pressure has decreased below the predetermined value, the diaphragm valve 18 will be closed to raise the fuel pressure with the fuel being sent in through the fuel pipe 13, thereby constantly maintaining the fuel at a predetermined pressure in the fuel passage 3. The outlet passage 21 is connected to the fuel tank through a fuel return pipe.

In the fuel delivery pipe 1, the fuel passage 3 is branched off into four branch passages 23, which open as fuel injection valve connecting ports 24 on the opposite side of the refrigerant outlet and inlet ports 6 and 7 of the fuel delivery pipe 1, equally spaced in the axial direction. Into each of these injection valve connecting ports 24 each of inserting sections 2*a* of the fuel injection valve 2 is inserted and fixed airtight. The fuel injection valve 2, including a built-in electromagnetic device inside, is opened, for a preset period of time at a predetermined time, by an electric signal supplied from an electronic control apparatus not illustrated to the electromagnetic device in accordance with the operating condition of the engine, thereby injecting a specific quantity of fuel, which is maintained at a specific pressure in the fuel passage 3 as described above, into the intake pipe from the fuel injection port 2*b*.

In the meantime the refrigerant in the air-conditioning system is sent into the refrigerant passage 4*a* through the refrigerant inlet pipe 6, flowing along the upper side of the fuel passage 3 toward the fuel inlet side, then flowing into the lower refrigerant passage 4*b* through the connecting passage 5, further flowing in the refrigerant 4*b* toward the fuel outlet side, i.e. toward the connecting block 14 side, and finally being returned into the air-conditioning system through the refrigerant outlet pipe 7. During this period, the fuel is cooled by heat exchange between the refrigerant and the fuel, through a partition wall section 25 separating the refrigerant passages 4*a* and 4*b* from the fuel passage 3.

In the present embodiment, the fuel delivery pipe 1 has both the fuel delivery function and the fuel cooling function, and therefore it is unnecessary to install the fuel delivery pipe and the fuel cooling device separately, thereby lowering the cost and simplifying pipe construction as well. Furthermore, since heat exchange is directly done between the fuel and the refrigerant and there is used no heat pipe between them, fuel cooling is done efficiently and moreover the branched passages 23 are cooled by the upper and lower refrigerant passages 4*a* and 4*b*. Therefore the fuel cooled in the fuel passage 3 will not rise in temperature until it reaches the fuel injection valve 2, thus enabling further improvement in fuel cooling effect. Furthermore, the fuel cooled in the fuel delivery pipe is partly returned into the fuel tank from the outlet passage 21, thereby preventing a rise in fuel temperature in the fuel tank.

While only one embodiment of the present invention has described, it will be apparent to those skilled in the art that various changes and modification may be made therein without departing from the spirit and scope of the present invention as claimed.

What is claimed is:

1. A fuel cooling device for motor vehicles equipped with a fuel injection engine in which fuel is cooled with refrigerant from an air-conditioning equipment, wherein a refrigerant passage for passing the refrigerant is provided within a fuel delivery pipe for delivering the fuel into fuel injection valves, juxtaposed with a fuel passage for passing the fuel and separated fluid-tight from said fuel passage whenever one or more branch passages are branched from said final passage and opened on a side surface of said fuel delivery pipe, openings of said branch passages being attached with fuel injection valves.

2. The fuel cooling device for motor vehicles as claimed in claim 1, wherein said fuel passage is longitudinally provided inside of said fuel delivery pipe, and said refrigerant passages separated from each other extend in parallel with said fuel passage at both sides of said fuel passage, said refrigerant passages communicating with each other at one end section of said fuel delivery pipe and communicating with a refrigerant inlet pipe and a refrigerant outlet pipe respectively at the other end section of said fuel delivery pipe.

3. The fuel cooling device for motor vehicles as claimed in claim 1, wherein said fuel passage and said refrigerant passage pass through said fuel delivery pipe in the axial direction, connecting blocks having passages communicating with said fuel passage are fixedly installed on both end faces of said fuel delivery pipe, and openings on both ends of said refrigerant passage are closed with said connecting blocks.

4. The fuel cooling device as claimed in claim 1, wherein a pressure regulator is provided for discharging a part of the fuel when a fuel pressure in said fuel passage has exceeded a specific value, said pressure regulator having an outlet passage communicating with a fuel tank.

* * * * *